US008251666B2

(12) United States Patent
Nishiyama et al.

(10) Patent No.: US 8,251,666 B2
(45) Date of Patent: Aug. 28, 2012

(54) BLADE AND FAN HAVING THE SAME

(75) Inventors: Toshihiko Nishiyama, Oyama (JP); Keiichi Inaba, Oyama (JP); Kengo Koshimizu, Oyama (JP)

(73) Assignee: Komatsu Ltd., Tokyo (JP)

( * ) Notice: Subject to any disclaimer, the term of this patent is extended or adjusted under 35 U.S.C. 154(b) by 1125 days.

(21) Appl. No.: 11/886,343

(22) PCT Filed: Mar. 13, 2006

(86) PCT No.: PCT/JP2006/004852

§ 371 (c)(1),
(2), (4) Date: Sep. 14, 2007

(87) PCT Pub. No.: WO2006/098254

PCT Pub. Date: Sep. 21, 2006

(65) Prior Publication Data

US 2008/0166234 A1 Jul. 10, 2008

(30) Foreign Application Priority Data

Mar. 14, 2005 (JP) ..... 2005-071269

(51) Int. Cl.
*F04D 29/34* (2006.01)

(52) U.S. Cl. ..... 416/210 R; 416/229 R; 416/238; 416/241 A

(58) Field of Classification Search ..... 416/169 A, 416/DIG. 3, 210 R, 229 R, 238, 241 A, 230
See application file for complete search history.

(56) References Cited

U.S. PATENT DOCUMENTS 4,778,339 A * 10/1988 Usui et al. ..... 416/39
2003/0231960 A1 * 12/2003 Asada et al. ..... 416/210 R

FOREIGN PATENT DOCUMENTS

CN 1330230 A 1/2002

(Continued)

OTHER PUBLICATIONS

The International Preliminary Report on Patentability (IPRP) (undated), issued in a counterpart International Application, English Translation Feb. 25, 2008.

(Continued)

*Primary Examiner* — Edward Look
*Assistant Examiner* — Jesse Prager
(74) *Attorney, Agent, or Firm* — Holtz, Holtz, Goodman & Chick, PC

(57) ABSTRACT

A blade of a hybrid type fan includes: a blade body 21 made of a synthetic resin; and a metallic insert 22 that is insert molded simultaneously with the blade body 21 and mounted to a mounting arm of a spider. At a corner on an outer side of a radial direction and a forward side of a rotary direction of the insert 22, a bulging portion 26 is provided to bulge toward the outer side of the radial direction and the forward side of the rotary direction. A bulging region 27 of the bulging portion 26 that the most prominently bulges toward the outer side of the radial direction is located to be forward in the rotary direction relative to a mounting center C of the insert 22 and the mounting arm along the radial direction.

4 Claims, 4 Drawing Sheets

FOREIGN PATENT DOCUMENTS

| | | | |
|---|---|---|---|
| JP | 1-209114 | A | 8/1989 |
| JP | 3-279699 | A | 12/1991 |
| JP | 4-370398 | A | 12/1992 |
| JP | 6-4396 | U | 1/1994 |
| JP | 2002-5086 | A | 1/2002 |
| JP | 2002-195190 | A | 7/2002 |

OTHER PUBLICATIONS

British Office Action dated Mar. 12, 2010 and English translation thereof in counterpart British Application No. GB0717966.6.

Chinese Office Action (and English translation thereof) dated Aug. 29, 2008, issued in a counterpart Chinese Application.

* cited by examiner

BLADE AND FAN HAVING THE SAME

This application is a U.S. National Phase Application under 35 USC 371 of International Application PCT/JP2006/304852 filed Mar. 13, 2006.

TECHNICAL FIELD

The present invention relates to a forward-swept shaped blade and a fan having the blade.

BACKGROUND ART

Conventionally, among cooling fans mounted to engines for construction machines, a fan with a comparatively small radial diameter has been made from a synthetic resin while a fan with a large radial diameter has been made from a steel plate.

On the other hand, a hybrid fan has been developed in recent years. In the hybrid fan, a body portion of a blade is basically manufactured by resin molding, where a metallic insert is embedded at the time of molding. The insert works as an attachment member for mounting the blade to a spider. The spider is made of a high-strength metal. Since the hybrid fan is the combination of the metallic spider, the metallic insert and the plastic blade body, the hybrid fan can have advantages of both the plastic fan and the steel fan. Thus, the hybrid fan is particularly expected to be widely used as a fan whose radial diameter ranges from medium to large.

According to a structure of the hybrid fan, a stress is concentrated on a base-end-side central portion of the spider and a tip-end-side corner portion of the insert. Particularly, depending on the stress concentrated on the corner portion of the insert, the blade may be damaged. The stress concentration has been conventionally observed to be caused by a flexure applied to the blade due to a centrifugal force at the time of a fan rotation. Proposals have been made to shape the insert such that no stress concentration is caused to the corner portion even when the flexure is applied (e.g., Patent Document 1). In short, by forming the insert to be homothetic with the blade, the stress concentration is prevented.

[Patent Document 1] JP-UM-A-06-4396

DISCLOSURE OF THE INVENTION

Problems to be Solved by the Invention

However, the inventors etc. of the present invention have found that a cause of the blade breakage is a blade resonance applied to the blade as a result of detailed analysis of a flexure applied to the blade in detail. The blade experiences a compound vibration of a primary bending vibration and a primary torsional vibration while rotating. The vibrations resonate with the fourth order rotational vibration which is inherent in the fan (a quadrangular radiator is generally used in a construction machine, and the fourth order rotational vibration is caused due to a pressure distribution of air entering thereinto through the quadrangular radiator), and a stress is consequently concentrated on a vibration node located at a corner portion of the insert to break the blade. In this case, the primary torsional vibration is particularly a problem. Accordingly, there is a demand for increasing an natural frequency of the primary torsional vibration to shift the primary torsional vibration to a range in which a resonance in accordance with the fourth order rotational vibration is avoided.

Based on the above-described observation, it is true that forming the insert to be homothetic with the blade is effective in increasing the natural frequency of the primary torsional vibration, but the stress concentration may be promoted depending on a homothetic ratio. Specifically, when an area of the insert is enlarged by a homothetic ratio that can reliably increase the natural frequency, a weight of the entire blade is increased, which leads to an increase in a centrifugal stress applied to the spider. Thus, the stress concentration on a base-end-side central portion of the spider due to the centrifugal stress becomes unignorable. Accordingly, it is important to reliably suppress the blade resonance without increasing the centrifugal stress.

An object of the present invention is to provide a blade with which a breakage is desirably prevented and a durability is improved and a fan having the blade.

Means for Solving the Problems

A blade according to an aspect of the present invention is a forward-swept shaped blade used for a fan that includes: a blade body made of a synthetic resin; and a metallic insert used for insert molding of the blade body and mounted to a mounting arm of a spider forming the fan, in which a bulging portion is provided on the insert at a corner on an outer side of a radial direction and a forward side of a rotary direction, the bulging portion bulging toward both the outer side of the radial direction and the forward side of the rotary direction, and a bulging region of the bulging portion that most prominently bulges toward the outer side of the radial direction is located to be forward in the rotary direction relative to a mounting center of the insert and the mounting arm along the radial direction.

According to the aspect of the present invention, since the insert is not homothetic with the blade but the bulging portion of the insert bulges in both in the radial and rotary directions, the natural frequency of the primary torsional vibration applied to the blade can be reliably increased within a range where the influence of the centrifugal stress is ignorable, so that a resonance is not caused when the blade is rotated, thereby effectively preventing the breakage of the blade.

In the blade according to the aspect of the present invention, it is desirable that a bulging length of the bulging portion relative to a body portion along the mounting center is set to be within a range of 2 to 10 percent of an average length of the entire insert, and a bulging width of the bulging portion relative to the body portion in a direction perpendicular to the mounting center is set to be within a range of 5 to 30 percent of an average width of the entire insert.

The body portion herein refers to a portion formed axisymmetrically to the mounting center.

According to the aspect of the present invention, since bulging amounts of the bulging portion are appropriately set, the above-described effect can be notably obtained.

In the blade according to the aspect of the present invention, it is desirable that at least in the bulging portion, a plurality of through holes are provided to penetrate a front and a back of the bulging portion.

According to the aspect of the present invention, since the plurality of through holes are provided at least in the bulging portion, the molten resin can be circulated on the front and back sides of the insert when the blade body is insert-molded, thereby easily and uniformly forming an extending portion that extends in the rotary direction of the blade body.

A fan according to another aspect of the present invention is a fan with the blade that includes: a metallic spider; and a plurality of forward-swept shaped blades, in which the blades include: a blade body made of a synthetic resin; and a metallic insert used for insert-molding of the blade body and mounted to a mounting arm of the spider, a bulging portion is provided on the insert at a corner on an outer side of a radial direction and a forward side of a rotary direction, the bulging portion bulging toward the outer side of the radial direction and the forward side of the rotary direction, and a bulging region of the bulging portion that most prominently bulges toward the outer side of the radial direction is located to be forward in the rotary direction relative to a mounting center of the insert and the mounting arm along the radial direction.

According to the aspect of the present invention, since the fan includes a plurality of blades that are configured identically with the above-described blade according to the present invention, the breakage of the blade is effectively prevented in the fan, thereby providing a fan having a blade that is excellent in durability.

In the fan with the blade according to the aspect of the present invention, it is desirable that a bulging length of the bulging portion relative to a body portion along the mounting center is set to be within a range of 2 to 10 percent of an average length of the entire insert, and a bulging width of the bulging portion relative to the body portion in a direction perpendicular to the mounting center is set to be within a range of 5 to 30 percent of an average width of the entire insert.

The body portion herein refers to a portion formed axisymmetrically to the mounting center.

According to the aspect of the present invention, since bulging amounts of the bulging portion are appropriately set, a fan having the blade which notably provides the above-described effect can be obtained.

In the fan with the blade according to the aspect of the present invention, it is desirable that at least in the bulging portion, a plurality of through holes are provided to penetrate a front and a back of the bulging portion.

According to the aspect of the present invention, since the molten resin can be circulated on the front and back sides of the insert when the blade body is insert-molded, a fan having the blade in which an extending portion that extends in the rotary direction of the blade body is uniformly formed can be obtained.

EXPLANATION OF CODES

Figure 1:
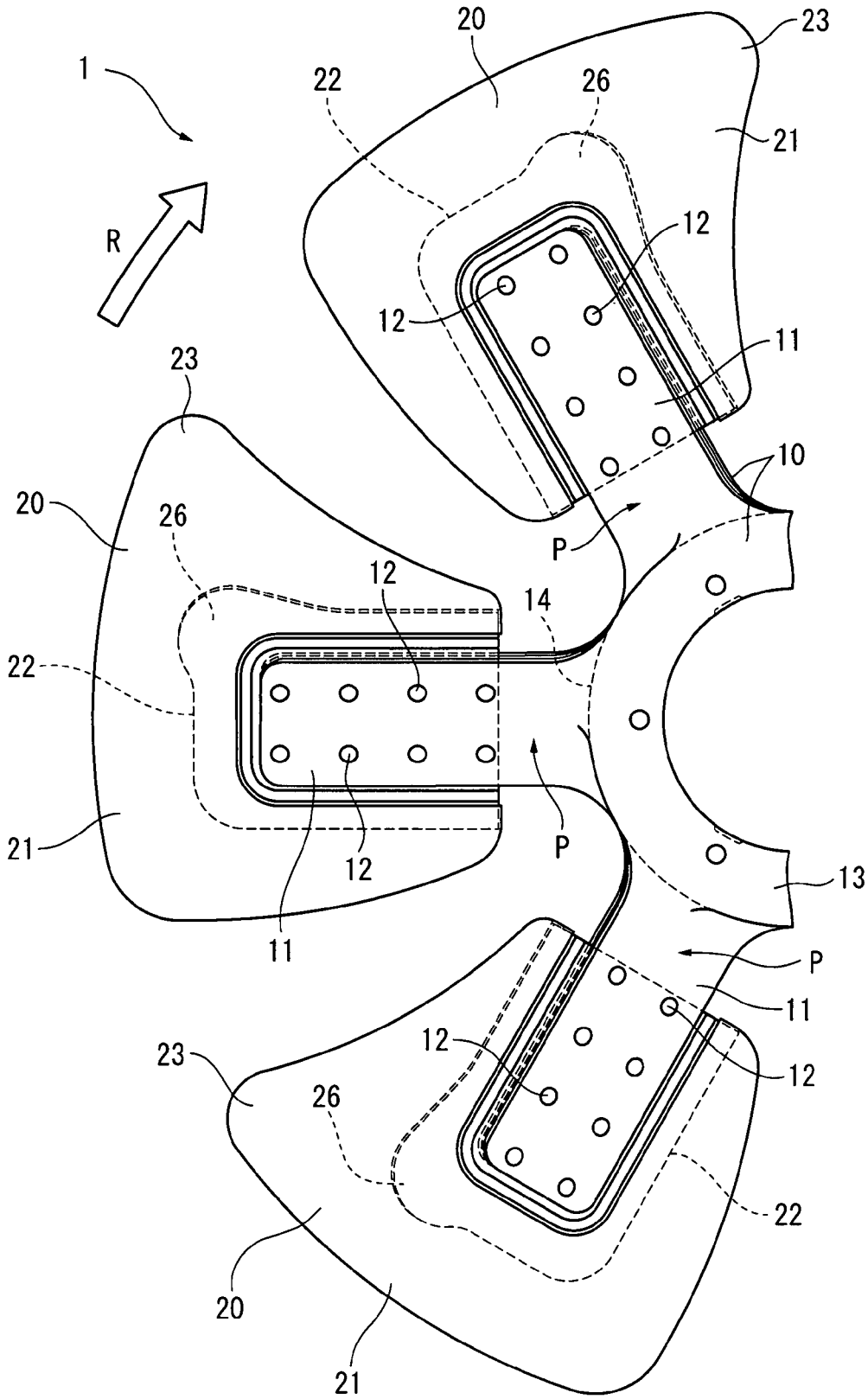
FIG. 1 is a front view showing a substantially half portion of a fan according to an embodiment of the present invention.

1: fan
10: spider
11: mounting arm
20: blade
21: blade body
22: insert
26: bulging portion
27: bulging region
28: body portion
C: mounting center
l1: bulging length
L1: average length
w1: bulging width
W1: average width

BEST MODE FOR CARRYING OUT THE INVENTION

An embodiment of the present invention will be described below with reference to the attached drawings.

Figure 2:
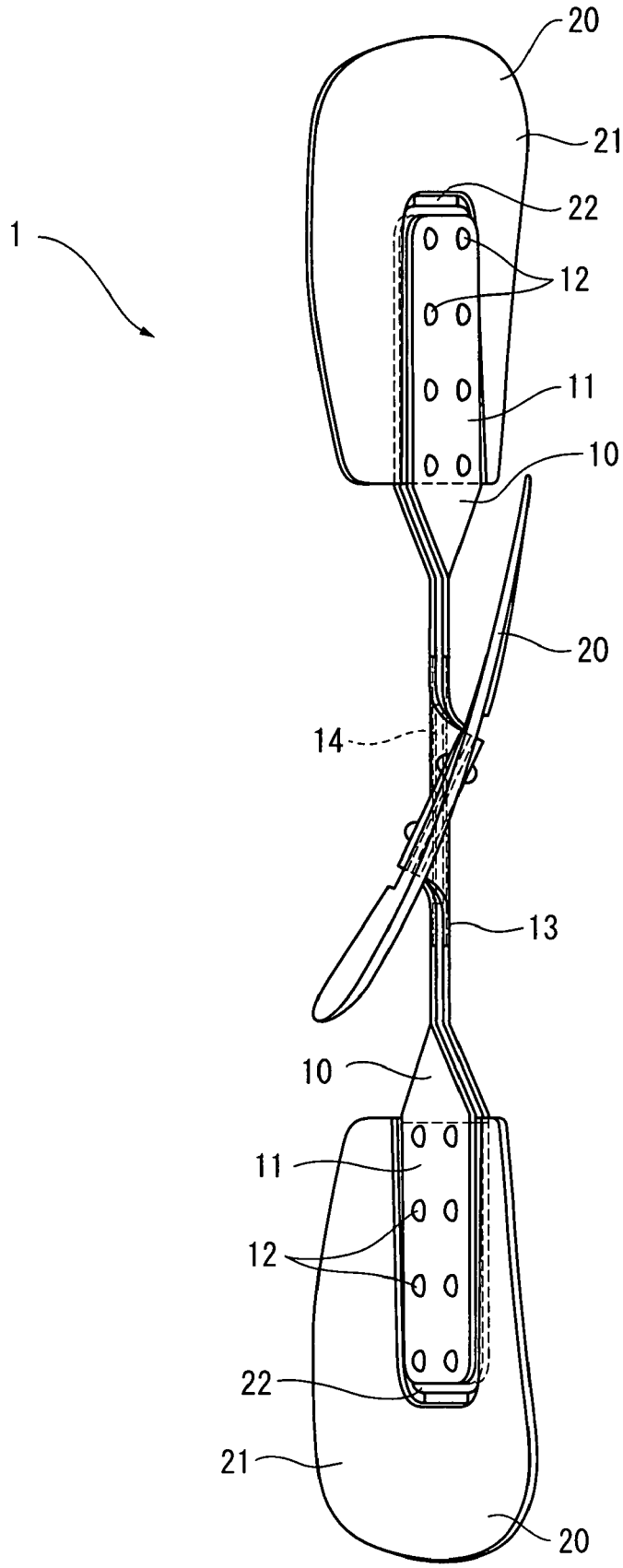
FIG. 2 is a side view showing the fan.

FIG. 1 is a front view showing a substantially half portion of a fan 1 according to the present embodiment, and FIG. 2 is a side view showing the fan 1.

In FIGS. 1 and 2, the fan 1 includes a metallic spider 10 and a plurality of blades 20 attached to the spider 10 (although six blades are used in the present embodiment, only three of the blades are shown).

A pair of spiders 10 are arranged in a superposing manner in a front-back direction of FIG. 1, each of which includes a plurality of mounting arms 11 circumferentially equally spaced (although six mounting arms are used in the present embodiment, only three of the mounting arms are shown). The blade 20 is held between the superposed mounting arms 11 to be attached thereto by a rivet 12. A central circular portion 13 of the spider 10 is fixed to an output shaft of an engine (not shown) by a bolt. In order to adjust a thickness, an annular member 14 is provided between the superposed circular portions 13 to be bolted to the output shaft together with the circular portions 13.

Figure 3:
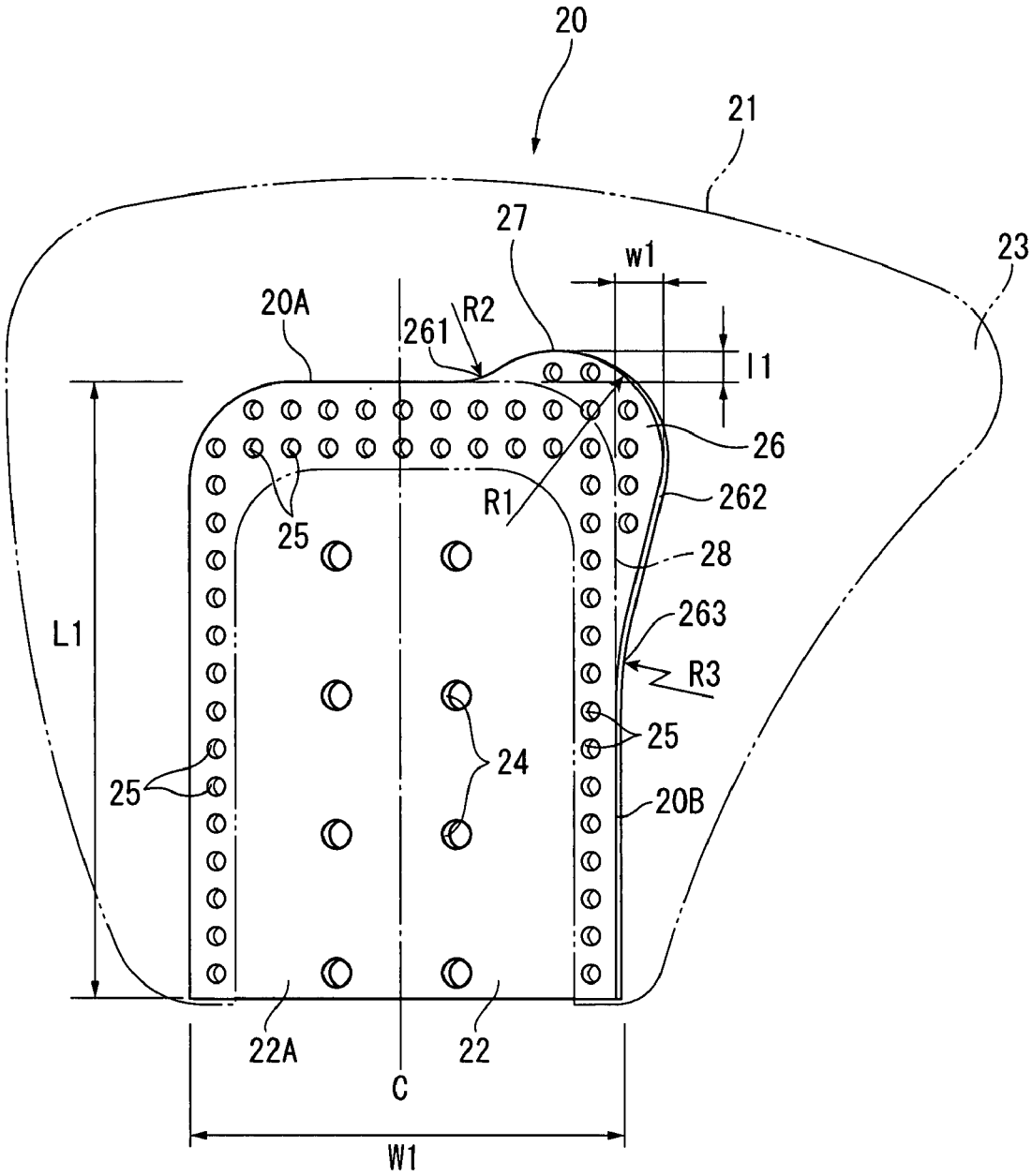
FIG. 3 is an enlarged view showing an insert that forms a blade.

The blade 20 includes a plastic blade body 21 and a metallic insert 22 that is insert-molded simultaneously with the blade body 21. The blade body 21 is formed by injecting molten resin into an insert molding die to be three-dimensionally shaped. The insert 22 is disposed in the molding die in advance. As shown in FIG. 3, the insert molding is performed such that the synthetic resin covers a periphery of the insert 22.

In FIGS. 1 and 3, the blade body 21 includes an extending portion 23 that extends toward an outer circumferential side of the blade body 21 and a forward side of a rotary direction R. With this arrangement, the entirety of the blade 20 is formed as a forward swept blade, thereby improving fan properties of the fan at the outer circumferential side. A size of the extending portion 23 is determined in accordance with fan properties etc. that are required when the fan is rotated at a predetermined engine speed.

In FIG. 3, the insert 22 is shaped such that only a mounting portion 22A to be mounted to the mounting arm 11 is flat while the other portions of the insert follows the shape of the blade body 21. In addition, the insert 22 includes a plurality of rivet holes 24 for mounting the insert 22 to the mounting arm 11 (eight holes in the present embodiment). In the periphery of the insert 22, there are provided a plurality of through holes 25 for circulating the molten resin in the molding operation on the front and back sides. At a corner of the insert 22 on the outer circumferential side and adjacent to the forward side of the rotary direction R, a bulging portion 26 is provided to share the same plane as a substantially quadrangular body portion 28 (see a dashed-dotted line with a short pitch). The bulging portion 26 bulges toward both an outer side of a radial direction and the forward side of the rotary direction R.

The shape of the entire insert 22 (including the bulging portion 26) and the shape of the entire blade 20 (including the extending portion 23) are not homothetic. It is because the extending portion does not extend in the radial direction. The extending portion does not extend in the radial direction since the outer circumferential shapes of the blades 20 are arced about a rotation center of the fan 1 in order to improve the fan properties. In short, the bulging portion 26 is greatly different from a conventional type in that the bulging portion 26 not only bulges toward the forward side of the rotary direction R but also bulges toward the outer side of the radial direction. Consequently, according to the present embodiment, a bulging region 27 formed at the outermost circumference of the bulging portion 26 is provided at a side of the rotary direction R that is forward relative to a mounting center C (see dashed-dotted line with a long pitch) of the insert 22 with the mounting arm 11 along the radial direction of the insert 22.

More specifically, in the bulging portion 26, a bulging length l1 measured from the body portion 28 along the mounting center C is set to be within a range of 2 to 10 percent of an average length L1 of the entire insert 22. When less than 2 percent, a natural frequency of a primary torsional vibration when the fan 1 is rotated is not desirably increased, which is not advantageous in preventing a resonance with a rotation quaternary vibration. When more than 10 percent, a centrifugal stress is increased due to an excessive increase in the weight of the blade 20. Thus, a stress concentration at a base-end-side central portion P of the mounting arm 11 (FIG. 1) is increased, which may degrade durability.

On the other hand, a bulging width W1 measured from the body portion 28 in a direction perpendicular to the mounting center C is set to be within a range of 5 to 30 percent of an average width W1 of the entire insert 22. When less than 5 percent, the natural frequency of the primary torsional vibration when the fan 1 is rotated is not desirably increased either, which is not advantageous in preventing the resonance with the rotation quaternary vibration. When more than 30 percent, the centrifugal stress is unignorablly increased and the stress concentration at the base-end-side central portion P of the mounting arm 11 is increased.

In addition, the outer circumference of the bulging portion 26 according to the present embodiment is formed to follow a single circular arc line with radius R1 (note that an arrow for indicating the radius R1 merely shows a position of the bulging portion. The length of the arrow does not corresponds to the length of the radius. The same applies to the other radiuses described later). The bulging portion 26 and a straight section 20A perpendicular to the mounting center C are continuously connected by a curved section 261 with radius R2 that is smaller than the radius R1. On the other hand, the outer circumference of the bulging portion 26 and a straight section 20B along the mounting center C are continuously connected by a straight section 262 extending along a line tangent to the arc with the radius R1 and a curved section 263 with radius R3 that is connected with the straight section 262. The radius R3 is by far larger than the radius R1.

As described above, by optimizing the shape of the bulging portion 26 provided to the insert 22 instead of forming the shape of the insert 22 to be homothetic with the shape of the entire blade 20, the natural frequency of the blade 20 within a range of the used engine speed can be reliably increased, thereby preventing the resonance with the fourth order rotational vibration mode. In addition, by arranging the bulging portion 26 not to bulge excessively, the stress concentration due to the centrifugal stress can be also prevented. Accordingly, the primary torsional vibration, which primarily occurs around a node in the vicinity of the bulging portion 26, can be effectively resisted, thereby preventing damages to the blade 20 and improving the durability.

Incidentally, the present invention is not limited to the embodiment described above, but includes other arrangements as long as an object of the present invention can be achieved, which also includes the following modification.

For example, as long as the bulging portion according to the present invention is provided such that the bulging region on the outermost circumference is forward in the rotary direction R relative to the mounting center, a specific shape of the bulging portion may be determined as desired in implementing the present invention. In the bulging portion 26 shown in FIG. 4, the outer circumference thereof and a curved section 20C on a rear side are continuously connected by a straight section 264 while the outer circumference of the bulging portion 26 and the straight section 20B are continuously connected by a curved section 265 with radius R4 that is smaller than the radius R1. By shaping the bulging portion as described above, the same effects can be obtained as in the above-described embodiment.

Figure 4:
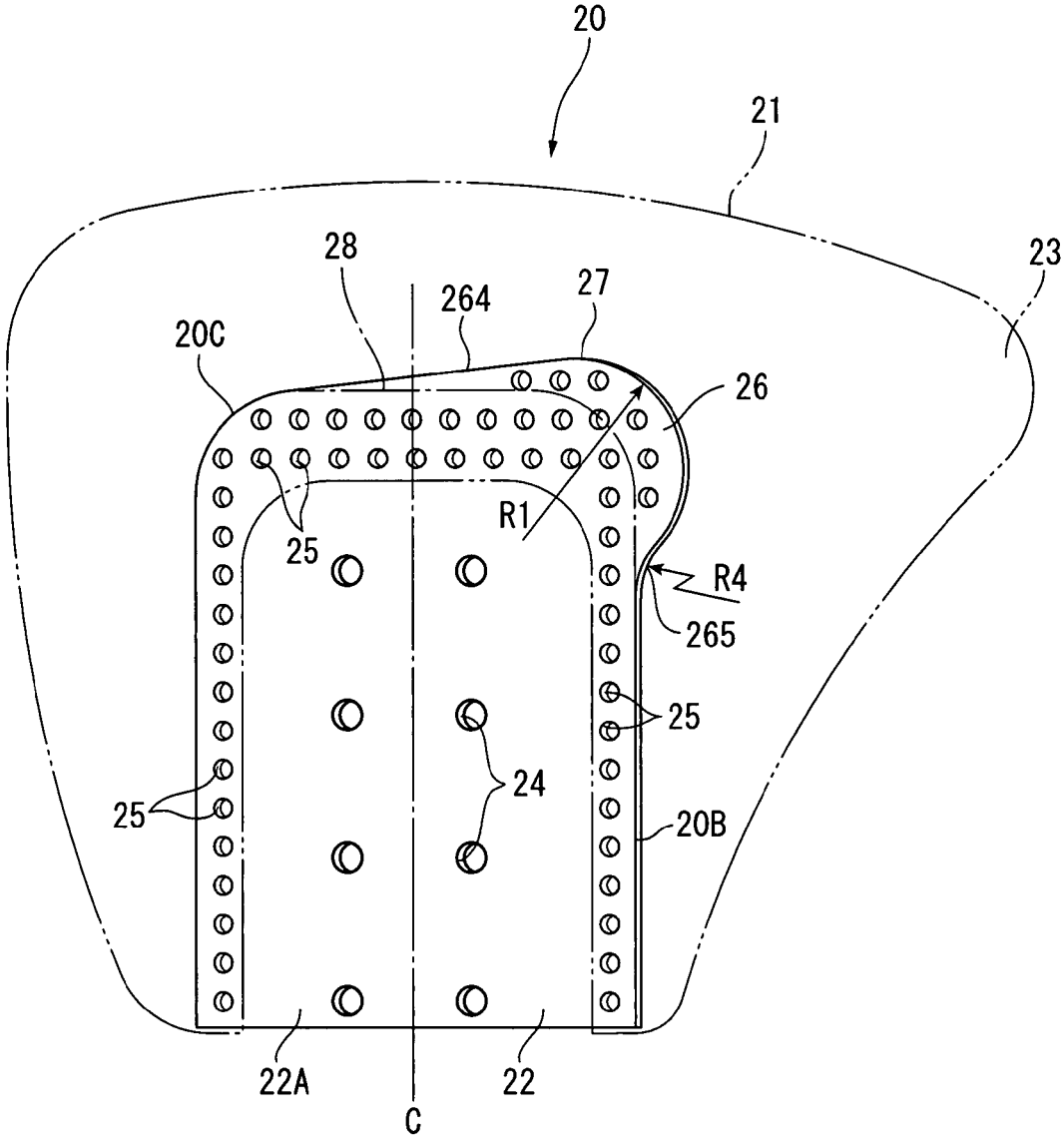
FIG. 4 is an enlarged view showing a modification of the present invention.

While the outer circumference of the bulging portion 26 and the straight section 20A are continuously connected by the curved section 261 with the radius R2 (FIG. 3), the outer circumference of the bulging portion 26 and the straight section 20B may be continuously connected by the curved section 265 with the radius R4 (FIG. 4). Alternatively, while the outer circumference of the bulging portion 26 and the curved section 20C is continuously connected by the straight section 264 (FIG. 4), the outer circumference of the bulging portion 26 and the straight section 20B may be continuously connected by the straight section 262 and the curved section 263 with the radius R3 (FIG. 3).

Although the best arrangement for implementing the present invention has been disclosed above, the present invention is not limited thereto. In other words, while the present invention has been described with reference to the specific embodiments and the drawings thereof, various modifications may be made to the disclosed embodiments by those of ordinary skill in the art without departing from the spirit and scope of the invention.

Therefore, the description that limits the shape and the material is only an example to make the invention easily understood, but is not intended to limit the invention, so that the invention includes the description using a name of component without a part of or all of the limitation on the shape and the material etc.

INDUSTRIAL APPLICABILITY

The present invention is applicable to an engine installed in a construction machine, particularly to a driven engine (not self-propelled type) for industrial equipments such as a power generator.

What is claimed is:

1. A forward-swept shaped blade for a fan, comprising:

a blade body made of a synthetic resin; and a metallic insert used for insert molding of the blade body and mounted to a mounting arm of a spider forming the fan, wherein:

a shape of the entire insert is not homothetic with a shape of the entire blade;

a bulging portion is provided on the insert at a corner on an outer side in a radial direction and a forward side in a rotary direction, the bulging portion bulging toward both the outer side in the radial direction and the forward side in the rotary direction, a bulging region of the bulging portion that most prominently bulges toward the outer side in the radial direction is located to be forward in the rotary direction relative to a mounting center of the insert and the mounting arm along the radial direction, the insert extends further toward the outer side in the radial direction at the bulging region than at a portion of the insert along the mounting center, a bulging length of the bulging portion relative to a body portion of the insert along the mounting center is set to be within a range of 2 to 10 percent of an average length of the entire insert, a bulging width of the bulging portion relative to the body portion in a direction perpendicular to the mounting center is set to be within a range of 5 to 30 percent of an average width of the entire insert, a first straight section perpendicular to the mounting center and a second straight section extending along the mounting center are provided on an outer circumference of the insert, and an outer circumference of the bulging portion comprises a first curved section of a first radius that is continuously connected with the first straight section and is dented inward in the radial direction, a second curved section of a second radius that is continuous with the first curved section and is protruded outward in the radial direction, and a third straight section tangent to the second curved section.

2. A fan, comprising:

a metallic spider; and a plurality of forward-swept shaped blades, wherein:

each of the blades includes a blade body made of a synthetic resin, and a metallic insert used for insert-molding of the blade body and mounted to a mounting arm of the spider, a shape of the entire insert is not homothetic with a shape of the entire blade;

a bulging portion is provided on the insert at a corner on an outer side in a radial direction and a forward side in a rotary direction, the bulging portion bulging toward both the outer side in the radial direction and the forward side in the rotary direction, a bulging region of the bulging portion that most prominently bulges toward the outer side in the radial direction is located to be forward in the rotary direction relative to a mounting center of the insert and the mounting arm along the radial direction, the insert extends further toward the outer side in the radial direction at the bulging region than at a portion of the insert along the mounting center, a bulging length of the bulging portion relative to a body portion of the insert along the mounting center is set to be within a range of 2 to 10 percent of an average length of the entire insert, a bulging width of the bulging portion relative to the body portion in a direction perpendicular to the mounting center is set to be within a range of 5 to 30 percent of an average width of the entire insert, a first straight section perpendicular to the mounting center and a second straight section extending along the mounting center are provided on an outer circumference of the insert, and an outer circumference of the bulging portion comprises a first curved section of a first radius that is continuously connected with the first straight section and is dented inward in the radial direction, a second curved section of a second radius that is continuous with the first curved section and is protruded outward in the radial direction, and a third straight section tangent to the second curved section.

3. The blade according to claim 1, wherein at least in the bulging portion, a plurality of through holes are provided to penetrate a front and a back of the bulging portion.

4. The fan according to claim 2, wherein at least in the bulging portion, a plurality of through holes are provided to penetrate a front and a back of the bulging portion.

* * * * *

UNITED STATES PATENT AND TRADEMARK OFFICE

CERTIFICATE OF CORRECTION

PATENT NO. : 8,251,666 B2
APPLICATION NO. : 11/886343
DATED : August 28, 2012
INVENTOR(S) : Toshihiko Nishiyama It is certified that error appears in the above-identified patent and that said Letters Patent is hereby corrected as shown below:

On the Title page:

Item (86) PCT No.:

Change "PCT/JP2006/004852" to --PCT/JP2006/304852--.

Signed and Sealed this
Eighth Day of January, 2013

David J. Kappos

David J. Kappos
*Director of the United States Patent and Trademark Office*